US005224808A

United States Patent [19]

Macris

[11] Patent Number: 5,224,808

[45] Date of Patent: Jul. 6, 1993

[54] WALL BOARD LIFTING AND POSITIONING APPARATUS

[76] Inventor: James Macris, 67 Horne St., Dover, N.H. 03820

[21] Appl. No.: 699,182

[22] Filed: May 13, 1991

[51] Int. Cl.[5] ..... B66F 11/00

[52] U.S. Cl. ..... 414/11; 414/590; 414/743; 414/732; 414/621; 414/639; 74/105

[58] Field of Search ..... 414/10, 11, 589, 590, 414/728, 738, 621, 639, 742, 729, 743, 732; 74/98, 105

[56] References Cited

U.S. PATENT DOCUMENTS

| | | | |
|---|---|---|---|
| 2,815,132 | 12/1957 | Stone | 414/11 |
| 2,828,870 | 4/1958 | Corley | 414/11 |
| 3,058,602 | 10/1962 | Kilman | 414/11 |
| 4,150,755 | 4/1979 | Trott et al. | 414/11 |
| 4,175,899 | 11/1979 | Tipton | 414/11 |
| 4,676,713 | 6/1987 | Voelpel | 414/540 |
| 4,696,613 | 9/1987 | Hahn | 414/11 |
| 4,859,138 | 8/1989 | Brocklebank et al. | 74/105 X |

FOREIGN PATENT DOCUMENTS

| | | | |
|---|---|---|---|
| 393004 | 10/1990 | European Pat. Off. | 414/11 |
| 117600 | 5/1990 | Japan | 414/11 |
| 1129067 | 12/1984 | U.S.S.R. | 414/590 |

*Primary Examiner*—Frank E. Werner
*Attorney, Agent, or Firm*—Robert S. Smith

[57] ABSTRACT

A wall board lifting and positioning apparatus which includes an elongated boom having first and second ends and apparatus for holding an associated individual panel. The apparatus for holding is carried on the elongated boom proximate to the first end thereof and apparatus for moving the boom through a plurality of substantially coplanar positions. The apparatus includes apparatus for pivoting and rotating the apparatus for holding to position the apparatus for holding. In some forms of the invention the apparatus for moving includes a first elongated control link and a second elongated control link. The boom may be supported on a head member. The first control link and the second control link may be each pivotally connected to the head member and may also be pivotally connected to the boom.

9 Claims, 5 Drawing Sheets

WALL BOARD LIFTING AND POSITIONING APPARATUS

BACKGROUND OF THE INVENTION

The invention relates to apparatus for lifting and positioning wallboard during the construction of residential and commercial buildings. The handling of wall board during the construction of residential and commercial buildings is particularly cumbersome and difficult. Typically, it is necessary to have several people to handle the individual wallboard panels.

This often requires two workers to handle the individual wallboard panels. The lifting and positioning of the wallboard panels or sections is particularly difficult if the panel is to be installed as part of the ceiling or as part of the upper sections of the walls of a room. At least one person must hold the wallboard sections if the wallboard is to be installed at higher elevations as part of the wall or as part of the ceiling. Mechanical apparatus is known to raise wallboard panels with a straight column that extends to raise the panels to the required elevation. Such apparatus is not satisfactory because it does not allow the operator the flexibility to precisely position the panel against the studs on which the panel will ultimately be carried.

It is an object of the invention to provide apparatus that will enable a single operator to quickly and easily install wallboard panels without assistance from any other person.

An additional object of the invention is to provide apparatus that is to provide apparatus that is very maneuverable and which will pass through even a narrow doorway.

Another object of the invention is to provide apparatus which may easily be collapsed or folded to be very compact and thus easy to move from one construction site to another.

Still another object of the invention is to provide apparatus which may easily be set up at a construction site.

It is an object of the invention to provide apparatus which is inexpensive to manufacture.

SUMMARY OF THE INVENTION

It has now been found that these and other objects of the invention may be attained in a wall board lifting and positioning apparatus which includes an elongated boom having first and second ends and means for holding an associated individual panel. The means for holding is carried on the elongated boom proximate to the first end thereof and means for moving the boom through a plurality of substantially coplanar positions. The apparatus includes means for pivoting and rotating the means for holding to position the means for holding.

In some forms of the invention the means for moving includes a first elongated control link and a second elongated control link. The boom may be supported on a head member. The first control link and the second control link may be each pivotally connected to the head member and may also be pivotally connected to the boom.

The means for moving may include a primary piston and cylinder assembly and may also include a first hydraulic pump. The primary piston and cylinder assembly may also be pivotally connected to the first control link. The means for moving may further include a secondary piston and cylinder that may support the head member. The secondary piston and cylinder may vary the vertical elevation of the head member.

The means for pivoting and rotating may include an elongated support arm which may have a round cross-section and the elongated support arm may be carried in a sleeve. The sleeve may be pivotally carried in a yoke and the sleeve may be dimensioned and configured to allow rotational movement of the elongated support arm within the sleeve.

The means for pivoting and rotating the elongated support arm may include an arm extending generally radially from the elongated support arm and may include a first and perhaps a second elongated rod which has at least a portion thereof threaded. The means for holding includes a plurality of over center clamps in some forms of the invention. The apparatus may include at least one stepped shaped pivotally carried member for supporting the associated panel and the pivotally carried member is deflected upon placement of the associated panel adjacent another already installed associated panel.

BRIEF DESCRIPTION OF THE DRAWING

The invention will be better understood by reference to the accompanying drawing in which.

DESCRIPTION OF THE PREFERRED EMBODIMENT

Figure 1:
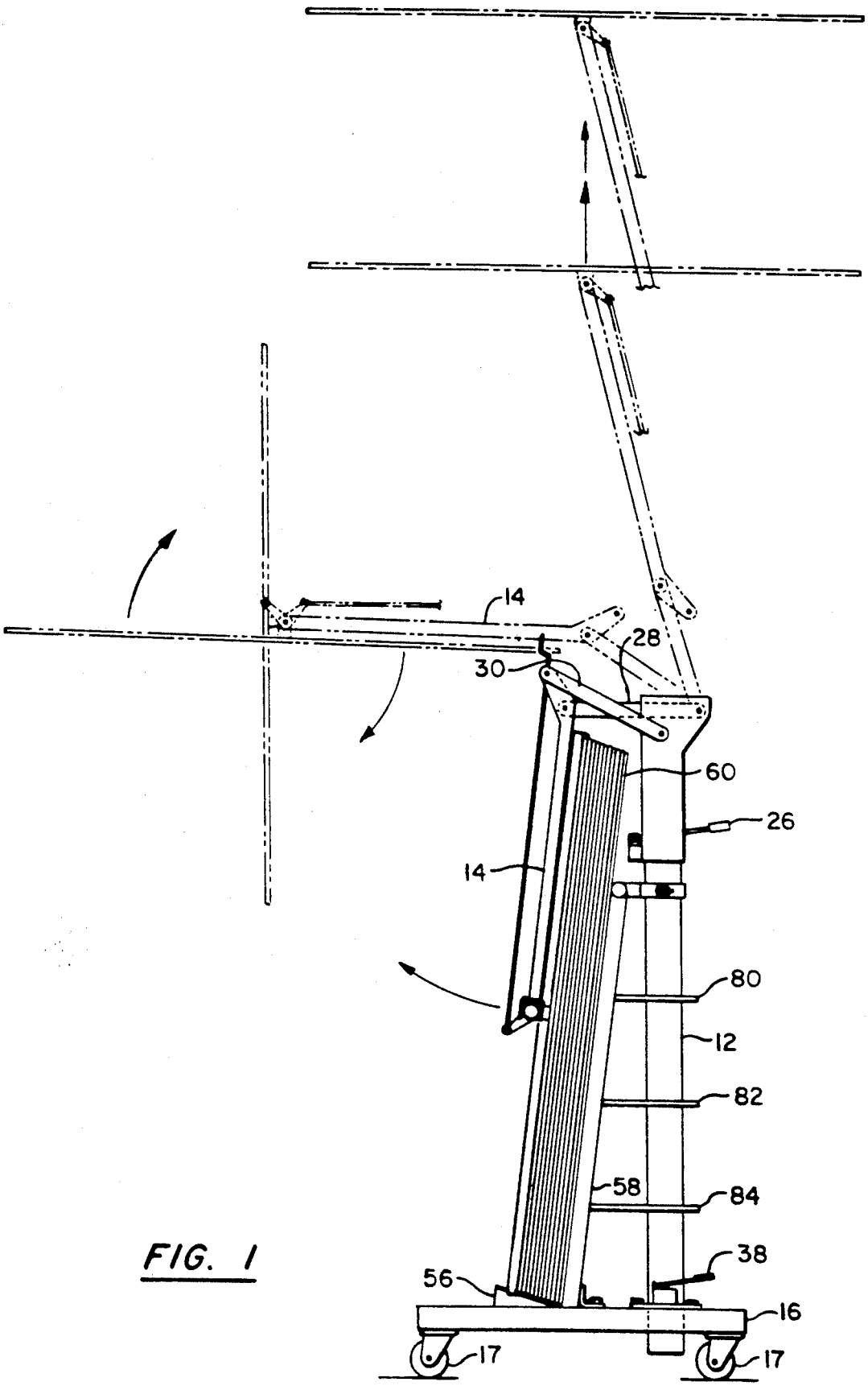
FIG. 1 is a side elevational view of a wall board lifting and positioning apparatus in accordance with one form of the invention in which a plurality of positions of the boom thereof are shown in phantom.

Referring now to FIGS. 1, 2, 3, 4, 5, and 6 there is shown a wall board lifting and positioning apparatus 10 in accordance with one form of the invention. The wall board lifting and positioning apparatus 10 includes a head member 11 fixed to the upper axial extremity of a telescoping section 13. The telescoping section 13 telescopes into a support column 12.

A boom 14 is carried on the head member 11 by means of a first control link 28 and a second control link 30. The second control link 30 is an elongated substantially straight link that has one axial extremity pivotally connected by a pivotal connection 31 to the head member 11. The opposite end thereof is coupled by a pivotal connection 32 to the axial extremity of the boom 14. The first control link 28 is provided with a first pivotal connection 33 that couples the right (as viewed in FIG. 4) axial extremity of the first control link 28 to the head member 11. The opposite axial extremity of the substantially straight first control link 28 is connected by a pivotal connection 34 to the boom 14 at a point spaced from the axial extremity thereof at which the boom 14 is pivotally connected to the to the second control link 30 by pivotal connection 32.

The support column 12 is carried on a base 16 which is supported by four casters 17. The support column 12 is easily removable from the base 16 for transport from one job site to another. Carried on the free end of the boom 14 is a support arm 18 that is pivotable and rotatable by means of the mechanism best shown in FIGS. 6, 2 and 3. In the preferred embodiment the support arm 18 is round tubing to permit rotation within the sleeve 22. Extensions 18A, 18A extend generally parallel to the support arm 18 and in they are made of square cross-section tubing. One face of each extension 18A, 18A is disposed in face to face abutting relationship against the wallboard 60 that is being installed. Similarly, legs 19, 19 are fixed to the support arm 18 at right angles at axially spaced points. The legs 19, 19 are preferably manufactured of square tubing and have a planar face thereof disposed in face to face abutting relationship with the wallboard 60.

The physical connection of the wall board lifting and positioning apparatus 10 to the wallboard 60 is further attained by the mechanisms best shown in FIGS. 7A, 7B, 8A, and 8B. Preferably, a plurality of wallboard 60 panels are loaded onto the lower support bracket 56 and upper support bracket 58. The number of wallboard 60 panels loaded at any one time will in some cases be limited by the capacity of the floor supporting the wall board lifting and positioning apparatus 10.

The operator will ordinarily position the boom 14 in the position shown in solid line in FIG. 1. The operator will then secure the four over-center clamps 46. 46, 46, 46 to the left-most wallboard 60 panel (as shown in FIG. 1) by movement of the handle 46A to the locked position shown in FIG. 8B. each of the over-center clamps 46 is pivotally carried on one axial extremity of one of the legs 19. Ordinarily, the operator will position the wallboard 60 panel against the wall or ceiling in the precise position in which it will be permanently installed. For installation on a horizontal ceiling the operator need only to disengage each over-center clamp 46 and nail the wallboard 60 in place.

Figure 7A:
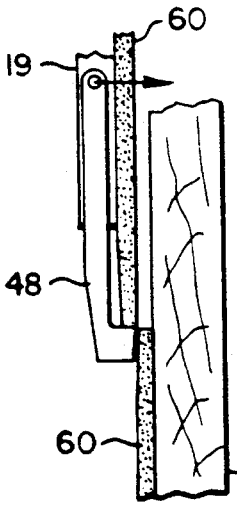
FIGS. 7A, 7B, 8A, and 8B are fragmentary side elevational views of the structure that grips the wallboard panels in the preferred embodiment of the invention.
Figure 7B:
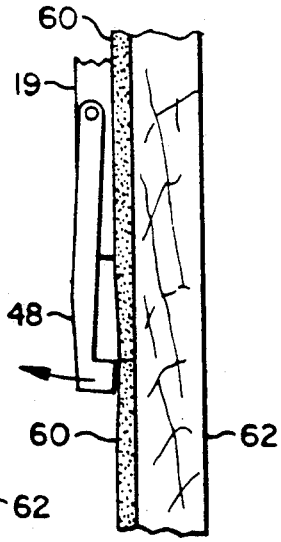
Figure 8A:
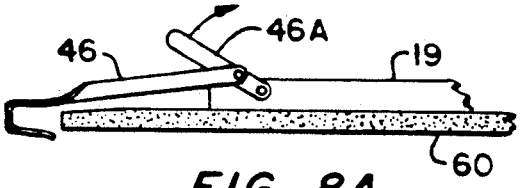
Figure 8B:
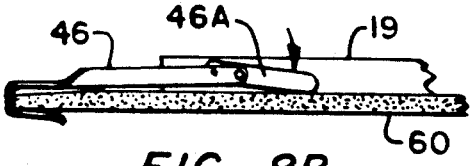

When installing wallboard 60 on a vertical wall the installation is still easily accomplished with the apparatus in accordance with the invention. More particularly, two pivotally mounted retaining arms 48 provide a lip that engages the lowermost edge of the wallboard 60 as shown in FIG. 7A. Each of the pivotally mounted retaining arms 48 are pivotally connected to an axial extremity of leg 19. It will be understood that the function of the pivotally mounted retaining arms 48 is to provide support the wallboard 60 just before installation against a vertical or oblique wall or ceiling. Thus, only two such pivotally mounted retaining arms 48 are necessary. The pivotally mounted retaining arms 48 are disposed at the uppermost edge of the wallboard 60 when the wallboard 60 is initially engaged by the support arm 18 and the two legs 19 and the four over-center clamps 46. As the wallboard 60 is moved, for example from the position shown in solid line to the position shown in phantom in which the boom 14 is substantially horizontal the over-center clamps 46 will be disposed at the lowermost edge of the wallboard 60. Accordingly as the wallboard 60 is slipped into position as best shown in FIG. 8B the pivotally mounted retaining arms 48 will provide support for the wallboard 60 until it is either nailed into place or rests on adjacent wallboard 60 panel as shown in FIG. 7B.

The wallboard 60 is positioned, in part, by means of movement of the boom 14. A primary piston and cylinder assembly 23 is pivotally carried on a lower pivot 24 within the head member 11. As hydraulic fluid is pumped into the primary piston and cylinder assembly 23 by means of a hand operated pump 26 the piston thereof moves and thus in the conventional manner the eye 25 of the connecting rod that is rigidly attached to the piston of the primary piston and cylinder assembly 23 is moved away from the lower pivot 24. The eye 25 is pivotally connected to an ear 34A of the first control link 28.

Figure 4:
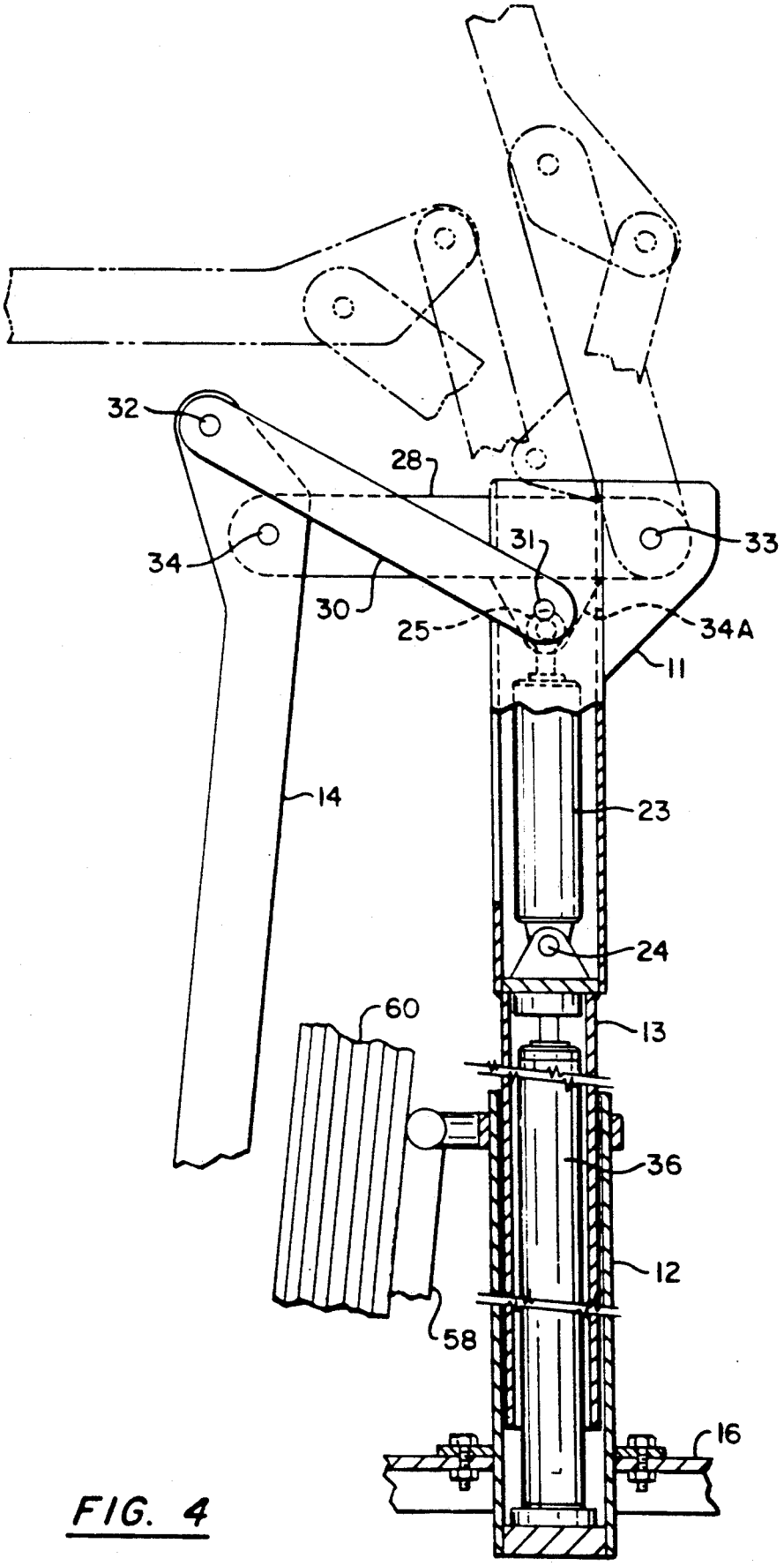
FIG. 4 is a fragmentary partially schematic view showing the linkage visible in FIG. 1 in greater detail.
Figure 5:
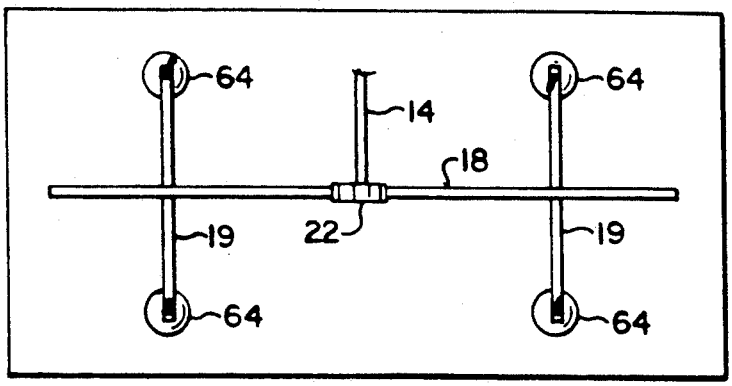
FIG. 5 is a plan view showing an alternative structure utilizing suction cups to grip the wallboard panel.

It will be seen that as the eye 25 moves away from the lower pivot 24 that the first control link 28 moves through a path illustrated by the phantom line representations shown in FIG. 4. The positions of the boom 14 and second control link 30 are determined solely by the position of the first control link 28.

The head member 11 is fixed to the telescoping section 13 which is telescoped into the support column 12. Within the support column 12 is disposed a secondary piston and cylinder 36 that is operated by a foot operated pump 38. This enables the operator to raise and lower the head member 11. This is particularly important for high ceiling installation jobs. In the preferred embodiment the primary piston and cylinder assembly 23 and secondary piston and cylinder 36 are hydraulic cylinders that are respectively operated by hand operated hydraulic pump 26 and foot operated hydraulic pump 38. In other forms of the invention pneumatic cylinders and pumps may be utilized. In still other forms of the invention electric motors and threaded shafts may utilized.

Figure 2:
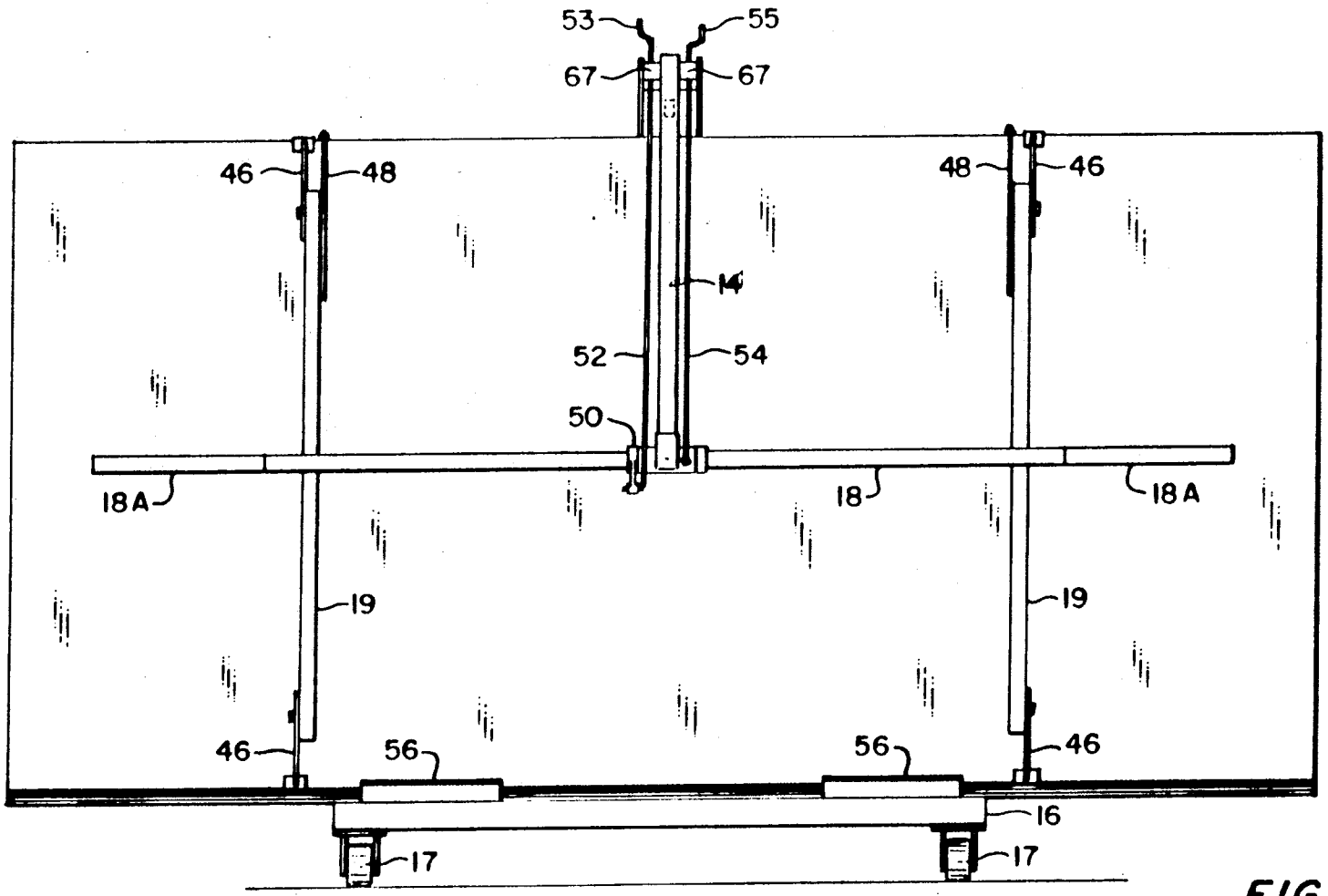
FIG. 2 is a front elevational view of the apparatus shown in FIG. 1 with the boom in the lowermost position.
Figure 3:
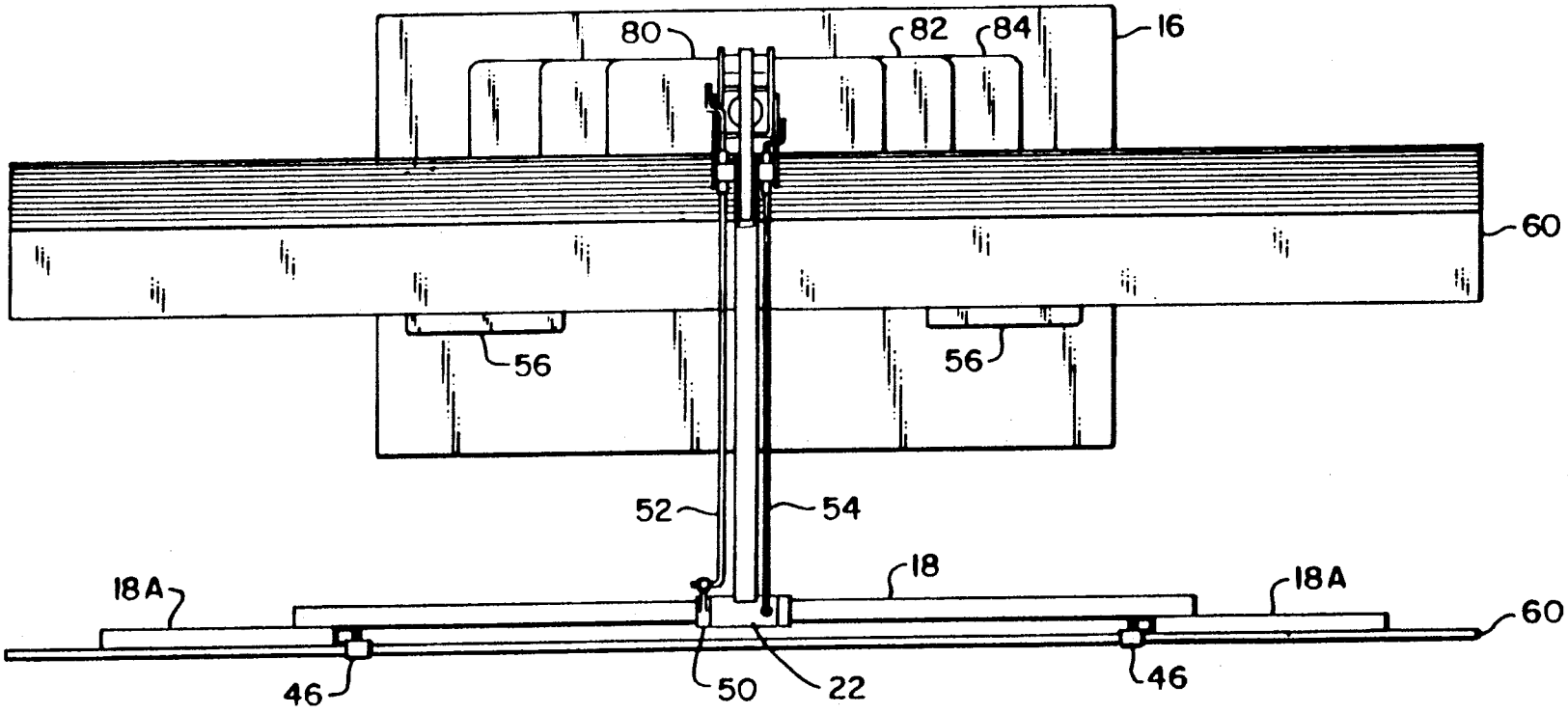
FIG. 3 is a top plan view of the apparatus shown in FIG. 1 with the boom thereof extended.
Figure 6:
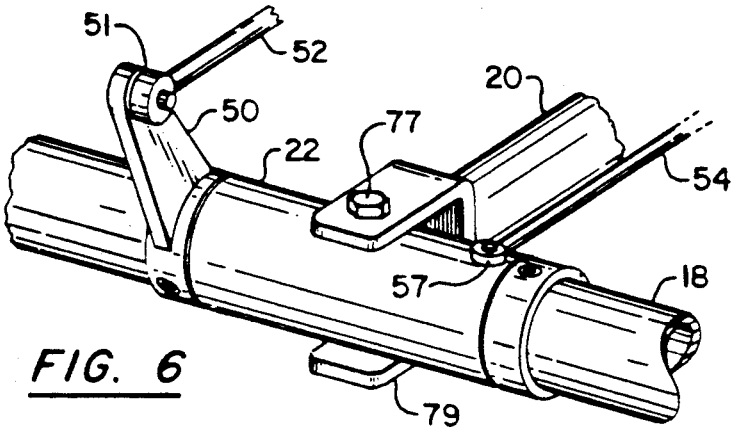
FIG. 6 is a fragmentary perspective view showing in greater detail the linkage between the boom and support arm visible in FIGS. 1–3.

The operator has still more control over the positioning of the wallboard 60 by means of the control arm 52 for rotational movement of the shaft 18 and control arm 54 for pivotal movement of the control arm 18. More specifically, these control arms as best seen in FIGS. 1, 2, and 3 include respectively threaded crank 53 for cooperation with control arm 52 for rotational movement of the shaft 18 and threaded crank 55 for cooperation with control arm 54 for pivotal movement of the control arm 18. It will be understood that the operator may easily rotate the threaded cranks to change the distance between the internally threaded supports pivotal connections 67, 67 and the other ends of the control arm 52 for rotational movement of the shaft 18 and control arm 54 for pivotal movement of the control arm 18. The operator may be standing on one of the integral ladder steps 82, 84, or 86 as he makes these adjustments. As best seen in FIG. 6 the movement of control arm 54 the sleeve 22 to pivot about pivot pin 77 which extends through the yoke 79. Thus, the support arm 18 is positioned and thereby the wallboard 60 is positioned.

Similarly the control arm 52 for rotational movement of the shaft 18 is cranked by the threaded crank 53 to that the operator can cause movement of the rotation arm 50 to rotate the support arm 18 and thus position the wallboard 60. It will be seen that the control arm 52 for rotational movement of the shaft 18 is coupled to the rotation arm 50 by a pivotal connection 51.

It will thus be seen that the operator may very easily position a plurality of wallboard 60 panels on the lower support bracket 56 and upper support bracket 58. Ordinarily, he would then engage the over-center clamps 46 with the top wallboard 60. Thereafter he may either use the casters 17 to position the entire wall board lifting and positioning apparatus 10 or may use the threaded crank 53, threaded crank 55, hand operated pump 26, and foot operated pump 38 to quickly and easily position the wallboard 60 panels.

In some embodiments of the invention the wallboard 60 may be held by suction cups 64 instead of the over-center clamps 46.

Although the invention has been described in terms of apparatus to position wallboard panels it will be understood that the apparatus in accordance with the invention or variations that will be apparent to those skilled in the art may be used to install panelling on interior walls as well as sheathing or other siding on buildings as well as other construction and non-construction applications. It will also be seen that the apparatus in accordance with the preferred form of the invention will maneuver through even the narrowest doorway and can easily be taken down to move to another construction site.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A wall board lifting and positioning apparatus which comprises:

a generally vertical column having an upper axial extremity;

a head member carried on said upper axial extremity;

an elongated boom having first and second ends and a geometric axis extending generally centrally therein from said first end to said second end;

first and second elongated control links, each of said control links being rigid members having respective uniform lengths at all times, said boom being coupled to said head member solely by said first and second elongated control members, said boom having no direct connection to said head member at all times and being disposed in spaced relationship to said head member at all times;

means for holding an associated individual panel, said means for holding including an elongated support arm disposed in substantially perpendicular relationship to said elongated boom, said means for holding being carried on said elongated boom proximate to said first end thereof;

means for moving said boom through a plurality of positions, said axis of said boom in each of said plurality of positions being disposed within a single plane; and means for pivoting and rotating said means for holding to position said means for holding, said first control link and said second control link are each pivotally connected to said head member, said first control link and said second control link are each pivotally connected to said boom, said elongated support arm having a round cross-section and said first end of said elongated boom includes a yoke and a sleeve, said elongated support arm being carried in said sleeve, said sleeve being pivotally carried in said yoke, said sleeve being dimensioned and configured to allow rotational movement of said elongated support arm within said sleeve, said means for pivoting and rotating said elongated support arm including an arm extending generally radially from said elongated support arm, said means for pivoting and rotating including a first elongated rod which has at least a portion thereof threaded, said means for pivoting and rotating including a second elongated rod which has at least a portion thereof threaded.

2. The apparatus as described in claim 1 wherein: said means for moving includes a primary piston and cylinder assembly.

3. The apparatus as described in claim 2 wherein: said means for moving includes a first hydraulic pump.

4. The apparatus as described in claim 3 wherein: said primary piston and cylinder assembly is pivotally connected to said first control link.

5. The apparatus as described in claim 4 wherein: said means for moving further includes a secondary piston and cylinder.

6. The apparatus as described in claim 5 wherein: said secondary piston and cylinder supports said head member.

7. The apparatus as described in claim 6 wherein: said secondary piston and cylinder varies a vertical elevation of said head member.

8. The apparatus as described in claim 7 wherein: said means for holding includes a plurality of over center clamps.

9. The apparatus as described in claim 8 wherein: said apparatus includes at least one stepped shaped pivotally carried member for supporting the associated panel and said pivotally carried member is deflected upon placement of the associated panel adjacent another already installed associated panel.

* * * * *